US008789327B2

(12) United States Patent
Junes

(10) Patent No.: US 8,789,327 B2
(45) Date of Patent: Jul. 29, 2014

(54) COLUMN SHOE

(75) Inventor: Markus Tapani Junes, Villahde (FI)

(73) Assignee: Peikko Group Oy, Lahti (FI)

( * ) Notice: Subject to any disclaimer, the term of this patent is extended or adjusted under 35 U.S.C. 154(b) by 0 days.

(21) Appl. No.: 13/880,866

(22) PCT Filed: Oct. 24, 2011

(86) PCT No.: PCT/FI2011/050928

§ 371 (c)(1),
(2), (4) Date: Apr. 22, 2013

(87) PCT Pub. No.: WO2012/056101

PCT Pub. Date: May 3, 2012

(65) Prior Publication Data

US 2013/0247488 A1 Sep. 26, 2013

(30) Foreign Application Priority Data

Oct. 26, 2010 (FI) ..... 20106110

(51) Int. Cl.
*E02D 27/32* (2006.01)

(52) U.S. Cl.
USPC ..... 52/297; 52/708; 52/293.3; 52/849; 52/251

(58) Field of Classification Search
USPC ..... 52/297, 293.3, 295, 296, 848, 849, 52/125.4, 125.5, 250, 251, 285.1, 285.2, 52/582.1, 704, 708; 403/286, 292–297, 403/300–305
See application file for complete search history.

(56) References Cited

U.S. PATENT DOCUMENTS

| | | | | | |
|---|---|---|---|---|---|
| 573,452 | A | * | 12/1896 | Delahunt | 52/92.2 |
| 1,805,731 | A | * | 5/1931 | Beckwith | 52/298 |
| 2,962,129 | A | * | 11/1960 | Howard | 403/78 |
| 3,551,959 | A | * | 1/1971 | Mastalski | 403/43 |
| 3,693,310 | A | * | 9/1972 | Middleton | 52/685 |
| 4,295,308 | A | * | 10/1981 | Korfanta | 52/296 |
| 4,343,125 | A | * | 8/1982 | Shubow | 52/236.8 |

(Continued)

FOREIGN PATENT DOCUMENTS

| | | | |
|---|---|---|---|
| DE | 19817832 | A1 * | 10/1999 |
| FI | 544 | | 2/1993 |

(Continued)

OTHER PUBLICATIONS

International Search Report issued in International Patent Application No. PCT/FI2011/050928 dated Feb. 2, 2012.

*Primary Examiner* — Robert Canfield
*Assistant Examiner* — Babajide Demuren
(74) *Attorney, Agent, or Firm* — Oliff PLC

(57) ABSTRACT

The object of the invention is a column shoe for securing steel concrete columns to a base. The column shoe includes a bolt housing, which includes a baseplate provided with a bolt hole, and an upper structure which is connected to the baseplate and to which at least one attachment unit is connected for securing the column shoe and the steel concrete column together. The bolt housing is fabricated by casting such that the upper structure and the baseplate form a single-piece casting. A hole is formed in the bolt housing for the attachment unit. The upper structure of the bolt housing comprises a sleeve structure which is formed integrally with the upper structure and on which the hole for the attachment unit is formed, and the upper structure includes a wall structure by which the sleeve structure is connected with the baseplate.

16 Claims, 7 Drawing Sheets

(56) References Cited

U.S. PATENT DOCUMENTS

| | | | | |
|---|---|---|---|---|
| 5,729,949 | A * | 3/1998 | Hartzheim | 52/677 |
| 6,161,339 | A * | 12/2000 | Cornett et al. | 52/23 |
| 2005/0102924 | A1 * | 5/2005 | Frohlich et al. | 52/155 |
| 2006/0078372 | A1 * | 4/2006 | Kanflod et al. | 403/286 |

FOREIGN PATENT DOCUMENTS

| | | | |
|---|---|---|---|
| FI | 95164 | | 9/1995 |
| FI | 104747 | B | 3/2000 |
| FI | 118186 | B | 8/2007 |
| SE | 511 606 | C2 | 10/1999 |

* cited by examiner

COLUMN SHOE

BACKGROUND OF THE INVENTION

The object of the invention is a column shoe according to the preamble of claim 1.

The invention relates to column shoes which are used in lower end corners and sides of steel concrete columns or corresponding concrete element columns for securing the column to the bolts in the column base structure.

From publication FI 118186 a column shoe for securing steel concrete columns to a base is known. The column shoe comprises a baseplate provided with a bolt hole and a sideplate secured to the baseplate by welding in order to form a bolt housing. The column shoe further comprises main attachments fixed to the bolt housing for securing the column shoe and the steel concrete column together. Column shoes of this type are also known from publications FI 95164 and SE 511 606.

One problem with these known column shoes is the eccentricity between the anchor bolt and the reinforcement bars serving as main attachments of the column shoe. Eccentricity generates horizontal forces on steel concrete column, which horizontal forces have to be encountered by adding reinforcement to the column. Eccentricity also increases internal stresses in the column shoe and creates need for rear attachment when column shoe is under compressive load. One further problem with these known column shoes is the connection between baseplate and sideplate, which is a welded connection and which for this reason generates stress peaks.

BRIEF DESCRIPTION OF THE INVENTION

The aim of the invention is to solve the above problems.

The object of the invention is obtained by the column shoe according to independent claim 1.

Preferred embodiments of the invention are described in dependent claims.

The invention is based on the idea that, since the bolt housing is fabricated by casting such that the bolt housing comprises a single-piece casting comprising a baseplate and a sideplate, no stress peaks are generated between the baseplate and the sideplate. This is because as a result of casting there is created a joint of uniform quality between the baseplate and the sideplate.

Another advantage obtained by the solution according to the invention is that, since a hole is formed in the bolt housing for securing the attachment unit to the bolt housing, which hole is coaxial with the bolt hole in the baseplate of the bolt housing, no rear attachment is in practice needed in the column shoe according to the invention in order to transfer forces.

The upper structure of the bolt housing according to the invention comprises a sleeve structure which is formed integrally with the upper structure and on which the hole for the attachment unit is formed, and the upper structure of the bolt housing comprises a wall structure by which the sleeve structure is connected with the baseplate, and the wall structure of the upper structure of the bolt housing comprises a plurality of wall structure portions by which the sleeve structure is connected with the baseplate. An advantage obtained by the solution according to the invention is that, since the wall structure is comprised of a plurality of wall structure portions, considerable savings may be achieved in wall structure materials, whereupon it will only be placed in locations where it is needed.

In general, such rear attachments must be used in order to transmit to the steel concrete column the lower horizontal force of the horizontal force couple generated by the eccentric position relative to the bolt situated at the location of the attachment unit and the bolt hole. In the solution according to the invention, due to the coaxiality of the hole and the bolt hole, the attachment unit, such as a reinforcement bar and underlying vertical anchor bolt arranged to the base, will at least partly, more preferably entirely, be situated substantially on the same axis, whereupon no eccentricity will be formed between the anchor bolt and the reinforcement bar. Since there is no eccentricity between the anchor bolt and the attachment unit, such as a reinforcement bar, there is no need for additional hooks in steel concrete column in order to take horizontal forces caused by eccentricity when column shoe is tension loaded. Thus, reinforcement of steel concrete column is reduced and simplified.

Due to the coaxiality column shoe has no stresses caused by eccentricity. This results in that the static model of the bolt housing is simplified. This also results in that the shape and dimensions of the bolt housing may be optimized from new and more simple starting points. Moreover, the capacity of the column shoe may be proved easily in a simple axial tension test without casting the product into the concrete.

Due to the coaxiality rear attachment is not needed for taking horizontal force caused by eccentricity when the column shoe is under compression load. Since rear attachment is not needed and since the shape and dimensions of the bolt housing may be optimized, the amount of steel in the column shoe is reduced and manufacturing costs of the column shoe are reduced.

By the solution of the invention it is possible to make a combination of column shoe-bolt with height of one layer, wherein the attachment unit of the column shoe serves simultaneously as column's main bar and coupler bolt. Total amount of steel in the column is reduced since no overlappings of reinforcement bar between column shoes, attachment unit of the column and anchor bolt are needed.

During transport and stocking bolt housings and column shoes take only little space.

Column shoe may be fabricated entirely without welding. A threaded reinforcement bar may serve as main attachment, or a rebar coupler pressed onto the reinforcement bar may be threaded in the threadings of the hole in the upper structure of the bolt housing. Alternatively the reinforcement bar serving as main attachment may be pressed directly in the hole of the upper structure of the bolt housing.

The bolt housing may include one or more attachment lugs formed during casting. Attachment lugs may also allow to increase bolt housing rigidity and to enhance attachment to the concrete. Lugs may also be used to secure column shoes together, for example by means of plates, such as hole plates, spiral rods, round rods, reinforcement bars or cable loops.

Bolt housings and their attached reinforcement bars may also be used as draw couplers of the bar like elements.

LIST OF FIGURES

Preferred embodiments of the invention will now be further described with reference to the accompanying Figures, in which.

DETAILED DESCRIPTION OF THE INVENTION

Figure 1:
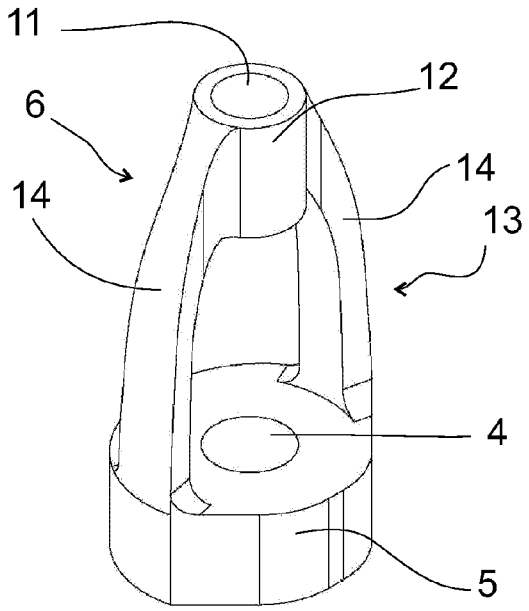
FIG. 1 shows a first preferred embodiment of the bolt housing of column shoe obliquely from above.
Figure 2:
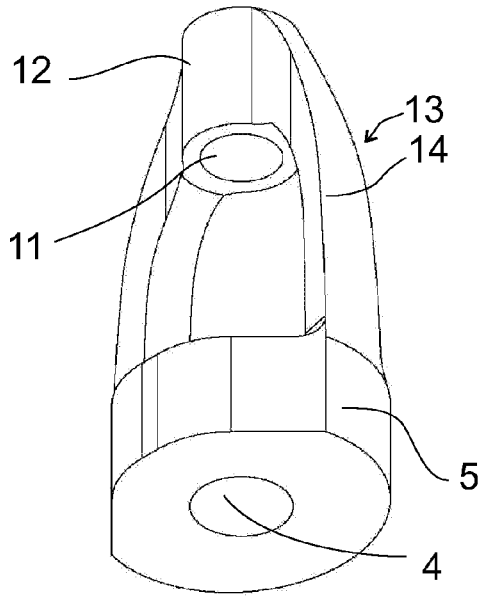
FIG. 2 shows the bolt housing of column shoe shown in FIG. 1 obliquely from below.
Figure 3:
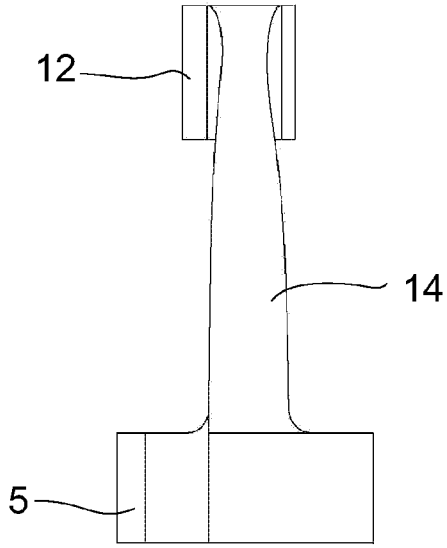
FIG. 3 shows the bolt housing of column shoe shown in FIG. 1 directly from side.
Figure 4:
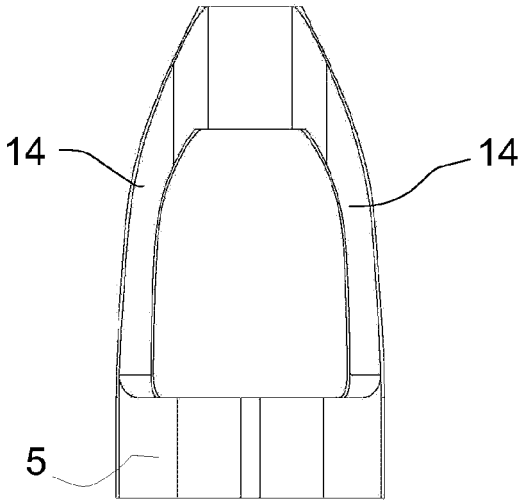
FIG. 4 shows the bolt housing of column shoe shown in FIG. 1 directly from front.
Figure 5:
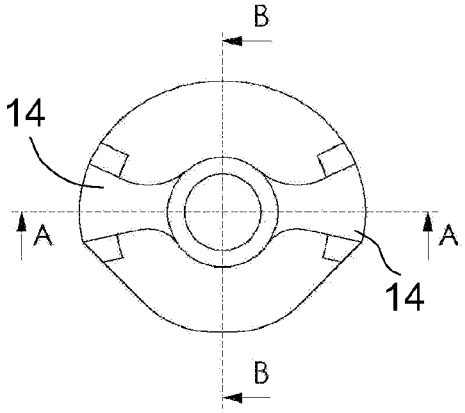
FIG. 5 shows the bolt housing of column shoe shown in FIG. 1 directly from above.
Figure 6:
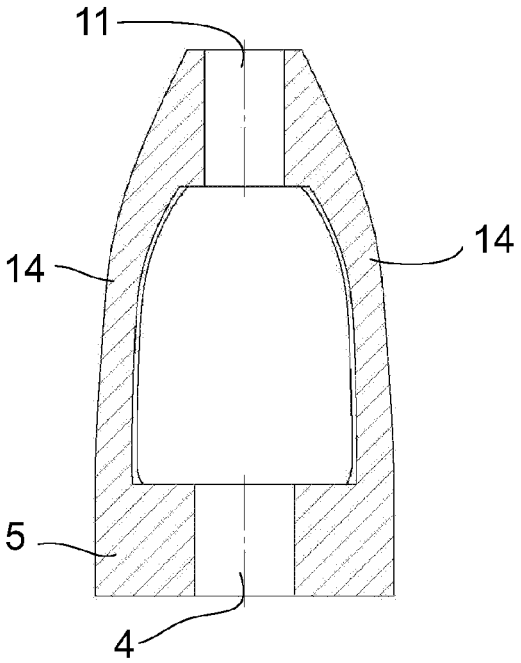
FIG. 6 shows the bolt housing of column shoe shown in FIG. 1 sectioned along line A-A of FIG. 5.
Figure 7:
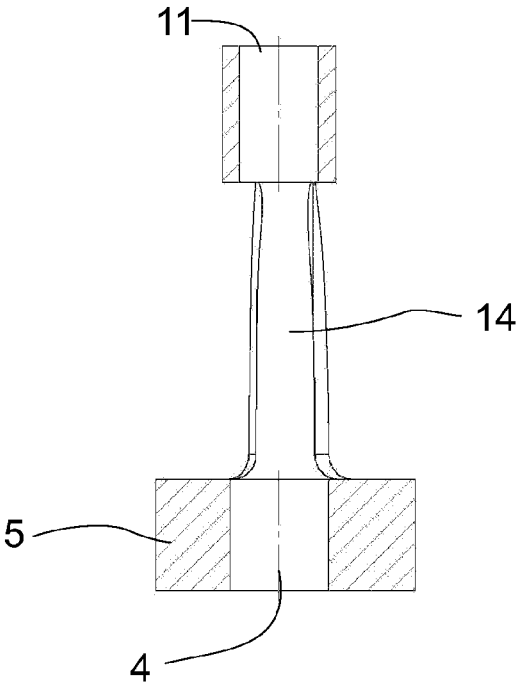
FIG. 7 shows the bolt housing of column shoe shown in FIG. 1 sectioned along line B-B of FIG. 5.

The object of the invention is a column shoe (not referenced) for securing steel concrete columns 1 such as concrete column elements to a base 2, such as a foundation of building or corresponding load-bearing structural element.

The column shoe comprises a bolt housing 3, which comprises a baseplate 5 provided with a bolt hole 4, and an upper structure 6 which is connected to a baseplate 5 and to which at least one attachment unit 7 is connected for securing the column shoe and the steel concrete column 1 together by casting the attachment unit 7 to the steel concrete column 1. Also a portion of the bolt housing 3, especially a portion of the upper structure 6 of the bolt housing 3, is casted in this same occasion to the steel concrete column 1.

Figure 14:
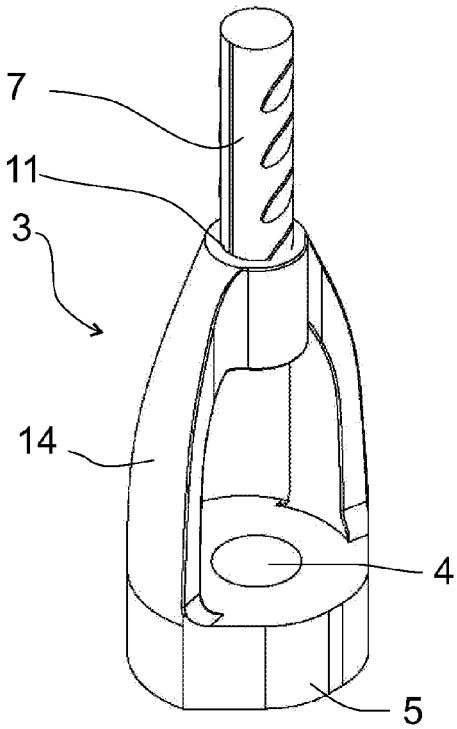
FIGS. 14 and 15 show the bolt housing of column shoe according to FIG. 1, to which an attachment unit in the form of a reinforcement bar is secured.
Figure 15:
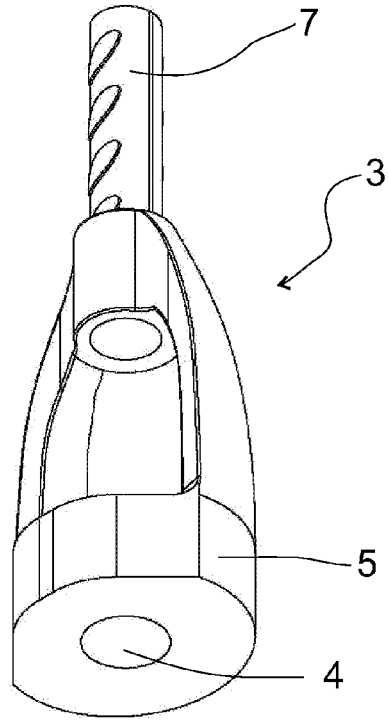
Figure 16:
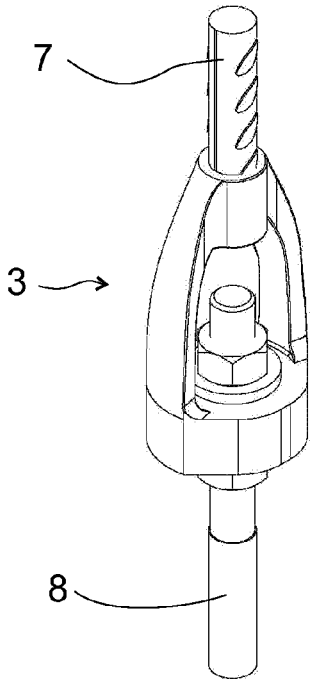
FIGS. 16 and 17 show the bolt housing of column shoe according to FIG. 1, to which an attachment unit in the form of a reinforcement bar is secured and on the baseplate of which an anchor bolt is secured.
Figure 17:
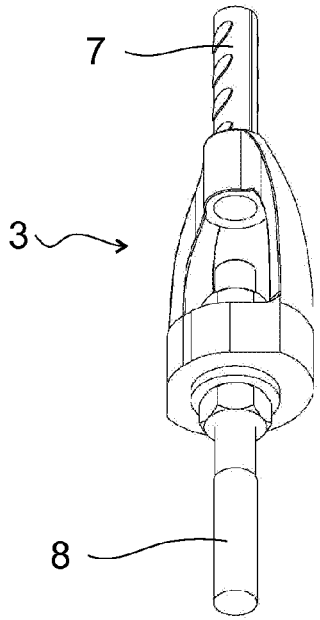
Figure 18:
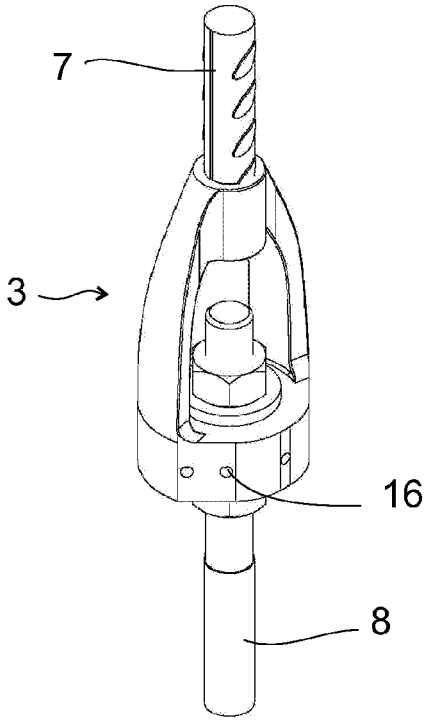
FIGS. 18 and 19 show the bolt housing of column shoe according to FIG. 1, to which an attachment unit in the form of a reinforcement bar is secured and on the baseplate of which an anchor bolt is secured and wherein the edge of the baseplate is moreover provided with holes for securing the hole plates.
Figure 19:
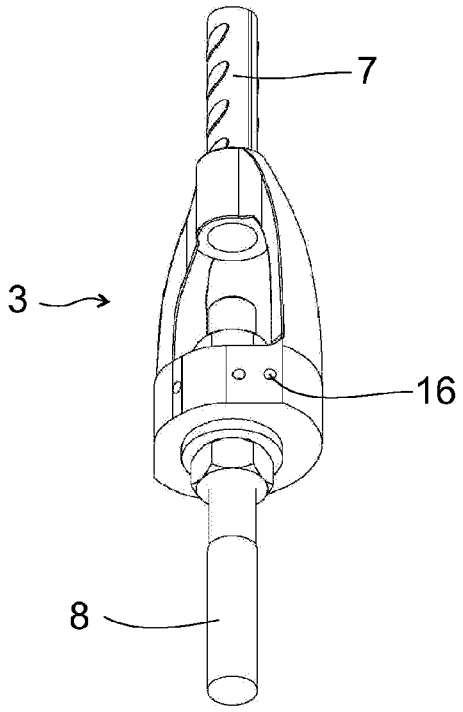
Figure 20:
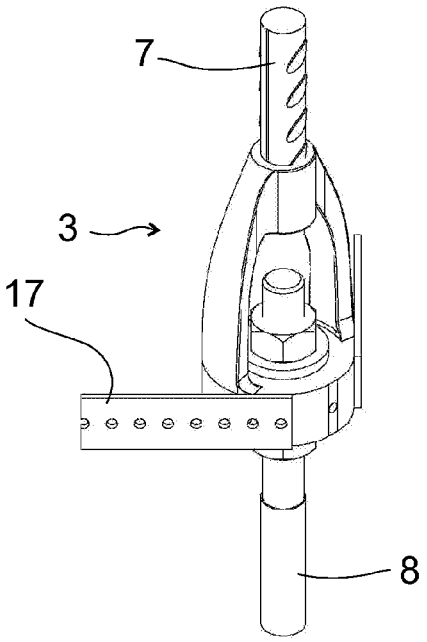
FIGS. 20 and 21 show the bolt housing of column shoe shown in FIGS. 18 and 19 in a state in which hole plates are secured to the baseplate.
Figure 21:
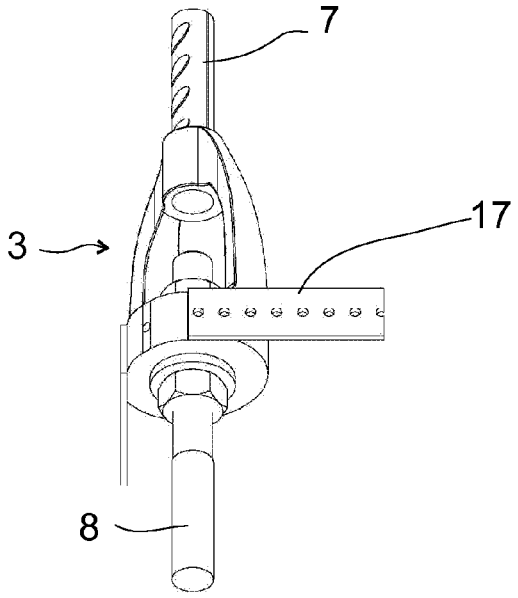

FIGS. 14 and 15 show an example of the column shoe.

Figure 22:
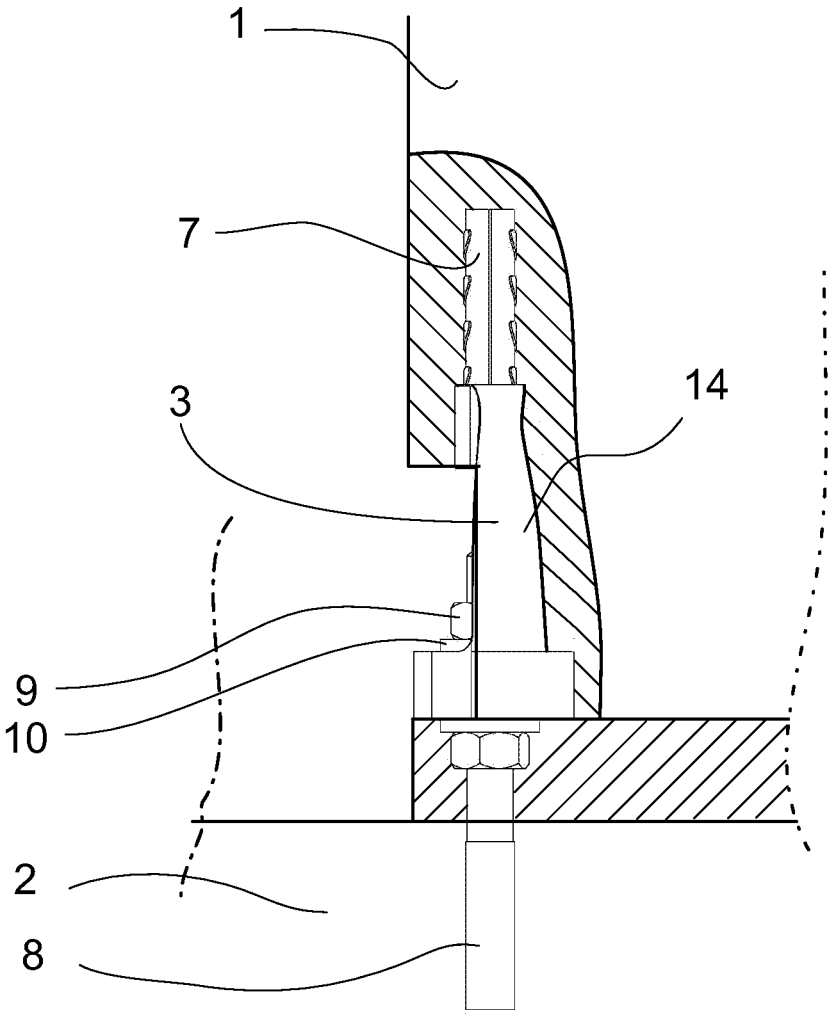
FIG. 22 shows the connection point between the steel concrete column and the base partly sectioned.

FIG. 22 shows partly sectioned an example of the connection point between the steel concrete column 1 and the base 2, wherein column shoe has been used for securing the steel concrete column 1 to the base 2. In FIG. 22 the vertical anchor bolt 8, partly cast to the base 2, traverses the bolt hole 4 in the baseplate 5 of the bolt housing 3. Anchor bolt 8 is provided with threadings (not referenced), to which nuts 9 and washers 10 are arranged in order to secure the column shoe to the vertical anchor bolt 8 in the base 2. In FIG. 22 the column shoe is secured to the steel concrete column 1 by casting the attachment unit 7 to the steel concrete column 1 and by casting the bolt housing 3 partly to the steel concrete column 1.

Figure 8:
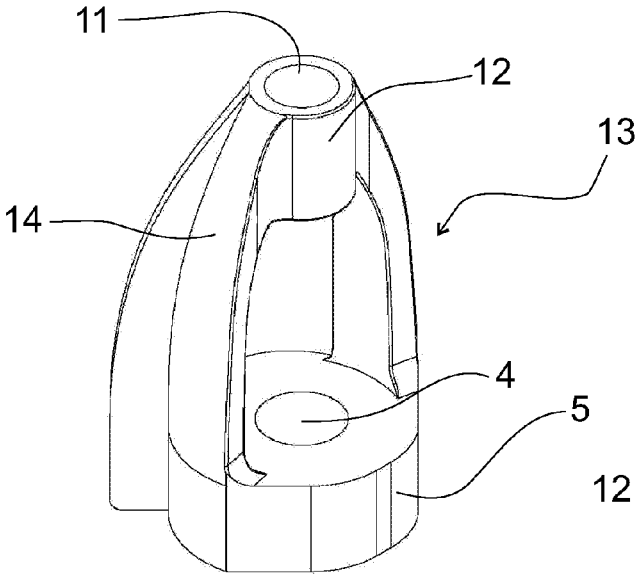
FIG. 8 shows a second preferred embodiment of the bolt housing of column shoe obliquely from above.
Figure 9:
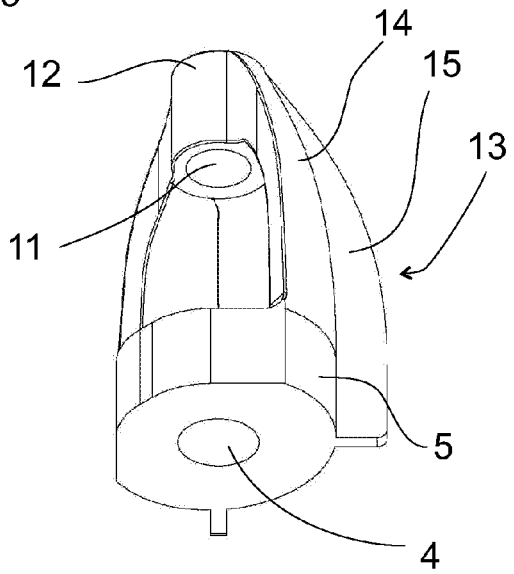
FIG. 9 shows the bolt housing of column shoe shown in FIG. 8 obliquely from below.
Figure 10:
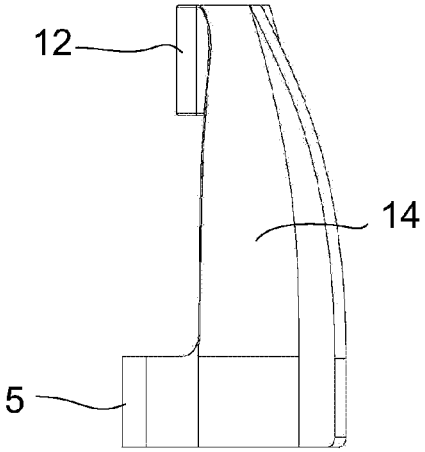
FIG. 10 shows the bolt housing of column shoe shown in FIG. 8 directly from side.
Figure 11:
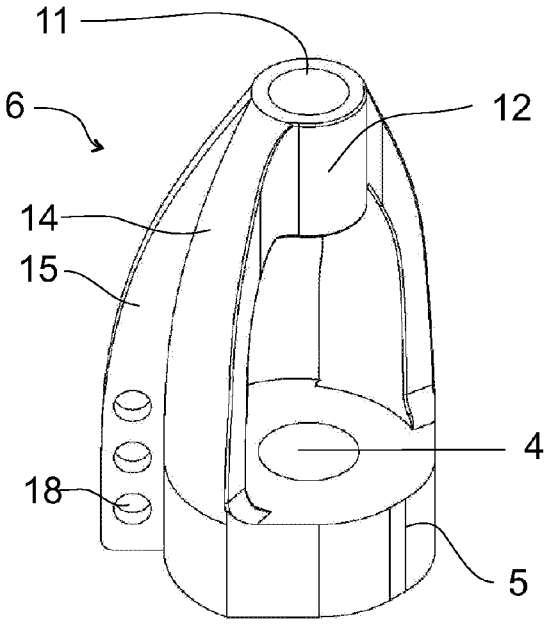
FIG. 11 shows a third preferred embodiment of the bolt housing of column shoe obliquely from above.
Figure 12:
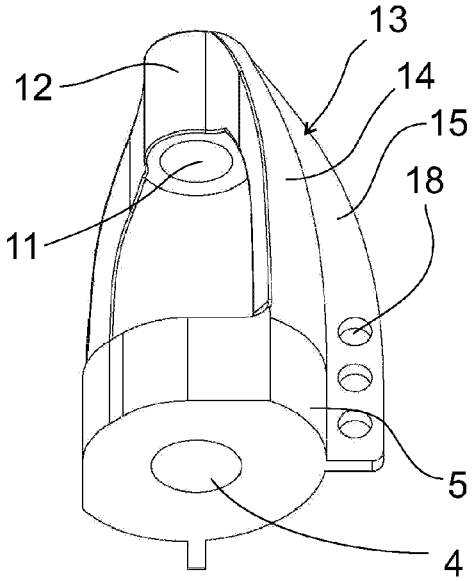
FIG. 12 shows the bolt housing of column shoe shown in FIG. 15 obliquely from below.
Figure 13:
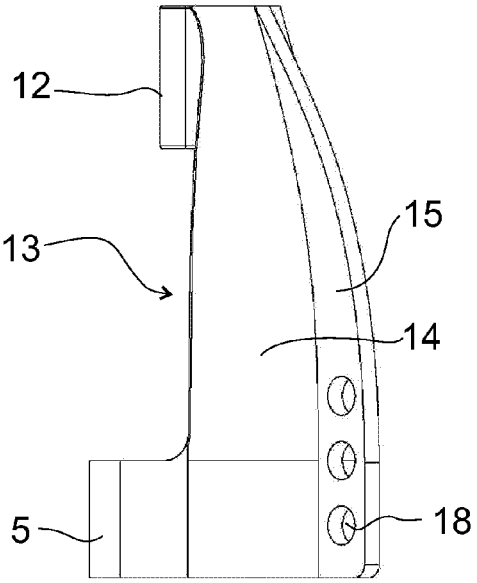
FIG. 13 shows the bolt housing of column shoe shown in FIG. 15 directly from side.

FIGS. 1 to 13 show four different bolt housings 3 of column shoe, wherein FIGS. 1 to 7 show a first embodiment of the bolt housing 3 of column shoe, FIGS. 8 to 10 show a second embodiment of the bolt housing 3 of column shoe, and FIGS. 11 to 13 show a third embodiment of the bolt housing 3 of column shoe.

The bolt housing 3 is fabricated by casting such that the upper structure 6 of the bolt housing 3 and the baseplate 5 form a single-piece casting. The casting is preferably, but not necessarily, fabricated from cast steel or cast iron. The bolt hole 4 of baseplate 5 may be formed in connection with casting or may be at least partly machined after casting.

A hole 11 is formed in the bolt housing 3 for the attachment unit 7. The hole 11 is substantially coaxial with the bolt hole 4 of the baseplate 5. This results in that, provided a rectilinear attachment unit 7 such as a rectilinear reinforcement bar is used in the column shoe, as shown in FIGS. 14 to 22, and provided a rectilinear anchor bolt 8 is used in the base 2 of steel concrete column 1 during mounting, the reinforcement bar and the anchor bolt 8 may be located substantially on the same axis whereupon no eccentricity is formed between the reinforcement bar and the anchor bolt 8. The hole 11 may be formed in connection with casting or may be at least partly machined after casting.

Further holes (not shown in Figures) may be formed in bolt housing 3, such as in the upper structure 6 of the bolt housing 3, for further attachment units (not shown in Figures), but more preferably only one hole 11 is formed in the bolt housing 3 for a single attachment unit 7, which hole 11 is substantially coaxial with the bolt hole 4 of the baseplate 5, as shown in Figures.

The upper structure 6 of the bolt housing 3, as shown in FIGS. 1 to 13, comprises a sleeve structure 12 which is formed integrally with the upper structure 6 and on which the hole 11 for the attachment unit 7 is formed. The upper structure 6 of the bolt housing 3, as shown in FIGS. 1 to 13, comprises a wall structure 13 by which the sleeve structure 12 is connected with the baseplate 5.

The upper structure 6 of the bolt housing 3 may be such that it is tapering in direction of the sleeve structure 12. Such bolt housings 3 are shown in FIGS. 1 to 13.

The wall structure 13 in the upper structure 6 of the bolt housing 3 may be at least partly arcuate in shape so that it is tapering in direction of the sleeve structure 12. Such bolt housings 3 are shown in FIGS. 1 to 13. In case the wall structure 13 in the upper structure 6 of the bolt housing 3 is at least partly arcuate in shape, it may at least partly have a parabolic shape. An advantage of this kind of arcuate, such as parabolic shaped wall structure 13 of upper frame 6 compared to a conventional vertical one is for example that it may better compensate forces and tensions in the bolt housing.

The wall structure 13 in the upper structure 6 of the bolt housing 3 is comprised of a plurality of wall structure portions 14 by which the sleeve structure 12 is connected with the baseplate 5. FIGS. 1 to 13 show a bolt housing 3, the wall structure 13 of which is comprised of two separate wall structure portions 14. The wall structure portions 14 may be arranged symmetrically in relation to the bolt hole 4 and the hole 11.

Alternatively the upper structure 6 of the bolt housing 3 may comprise a wall structure 13, on which a hole 11 is formed for the attachment unit 7. Then, the wall structure 13 in the upper structure 6 of the bolt housing 3 may be such that it is tapering in direction away from the baseplate 5. Alternatively, the wall structure 13 in the upper structure 6 of the bolt housing 3 may be at least partly arcuate in shape so that it is tapering in direction away from the baseplate 5. In case the wall structure 13 in the upper structure 6 of the bolt housing 3 is at least partly arcuate in shape, it may at least partly have a parabolic shape.

The bolt housing 3 may consist of a single-piece casting, as shown in FIGS. 1 to 13.

The attachment unit 7 of column shoe comprises preferably, but not necessarily, a reinforcement bar. FIGS. 14 to 22 show column shoes, in which one reinforcement bar serves as attachment unit 7. The reinforcement bar is preferably, but not necessarily, substantially rectilinear.

In case the attachment unit 7 is a reinforcement bar, the diameter of the hole 11 is preferably, but not necessarily, such that it substantially corresponds to the diameter of the reinforcement bar.

In case the attachment unit 7 is a reinforcement bar, the hole 11 may be provided with inner threads (not shown in Figures) and the reinforcement bar may be provided with outer threads (not shown in Figures) which are adapted to cooperate with the inner threads of the hole 11 so that the reinforcement bar is secured to the bolt housing 3 by screwing the reinforcement bar to the hole 11 of the bolt housing 3. In case there is one reinforcement bar as attachment unit 7, the reinforcement bar is preferably, but not necessarily, substantially rectilinear and substantially circular in cross-section so that the reinforcement bar is substantially coaxial with the bolt hole 4 in the baseplate 5 of the bolt housing 5.

The attachment unit 7 may be secured to the bolt housing 3 by pressing the bolt housing 3 into engagement with the attachment unit 7 arranged in hole 11 by pressing the bolt housing 3 at the location of the hole 11.

The attachment unit 7 may be secured to the hole 11 by means of a sleeve (not shown in Figures), which is arranged into the hole 11 and on which the attachment unit 7 is arranged so that for example a crimp connection is formed between the hole 11 and the sleeve and respectively between the sleeve and the attachment unit 7.

Attachment lugs 15, which protrude from the bolt housing 3 may be formed by casting to the bolt housing 3. Such bolt housings 3 are shown in FIGS. 8 to 13. Attachment lugs 15 may be provided with holes 18, as shown in FIGS. 11 to 13. Attachment lugs 15 are used for enhancing the fastening of the bolt housing 3 to the steel concrete column 1. Such attachment lugs 15 also permit to increase the rigidity of the bolt housing 3. During assembly phase of the column shoe, a wire or a reinforcement bar may be passed through the eventual holes 18 of the attachment lugs 15 in order for example to secure a plurality of column shoes together.

Holes 16 may be formed in the edge of the baseplate 5 of the bolt housing 3 for securing at least one hole plate 17. Hole plates 17 are shown in FIGS. 18 and 19 and FIGS. 20 and 21. Such hole plate 17 permits for example a plurality of column shoes to be secured together or a column shoe to be secured to for example a cast mold or equivalent during mounting, when the column shoe is at least partly cast to the steel concrete column 1.

The upper structure 6 of the bolt housing 3 shown in FIGS. 1 to 7 comprises a wall structure 13, which is comprised of two wall structure portions 14 by which the sleeve structure 12 is connected with the baseplate 5.

FIGS. 8 to 10 show a second embodiment of the bolt housing 3 of column shoe. The bolt housing 3 shown in FIGS. 15 to 21 differs from the bolt housing 3 shown in FIGS. 1 to 7 in that two attachment lugs 15, which protrude from the bolt housing 3 are formed by casting to the bolt housing 3. Attachment lugs 15 are used for enhancing the fastening of the bolt housing 3 to the steel concrete column 1.

FIGS. 11 to 13 show a third embodiment of the bolt housing 3 of column shoe. The bolt housing 3 shown in FIGS. 22 to 28 differs from the bolt housing 3 shown in FIGS. 8 to 10 in that two attachment lugs 15 provided with holes 18 are formed by casting to the bolt housing 3.

It is obvious to a person in the art that as technology advances, the inventive concept can be implemented in various ways. Therefore the invention and the embodiments thereof are not limited to the examples shown hereinbefore but may vary within the frames of the claims.

The invention claimed is:

1. Column shoe for securing steel concrete columns to a base, comprising:

a bolt housing comprising a baseplate provided with a bolt hole; and an upper structure which is connected to the baseplate and to which at least one attachment unit is connected for securing the column shoe and the steel concrete column together; wherein:

the bolt housing is a single-piece casting that comprises the upper structure and the baseplate, a hole is formed in the bolt housing for the attachment unit, the hole is substantially coaxial with the bolt hole of the baseplate, the upper structure of the bolt housing comprises a sleeve structure which is formed integrally with the upper structure and on which the hole for the attachment unit is formed, the upper structure of the bolt housing comprises a wall structure by which the sleeve structure is connected with the baseplate, and the wall structure in the upper structure of the bolt housing comprises a plurality of wall structure portions by which the sleeve structure is connected with the baseplate.

2. Column shoe according to claim 1, wherein the wall structure portions are arranged symmetrically in relation to the bolt hole and the hole.

3. Column shoe according to claim 1, wherein the wall structure of the bolt housing tapers in a direction towards the sleeve structure.

4. Column shoe according to claim 1, wherein the wall structure of the bolt housing is at least partly arcuate in shape so that the wall structure of the bolt housing tapers in a direction towards the sleeve structure.

5. Column shoe according to claim 1, wherein the wall structure of the bolt housing tapers in a direction away from the baseplate.

6. Column shoe according to claim 1, wherein the wall structure in the upper structure of the bolt housing is at least partly arcuate in shape so that the wall structure of the bolt housing tapers in a direction away from the baseplate.

7. Column shoe according to claim 1, wherein the attachment unit is a reinforcement bar.

8. Column shoe according to claim 7, wherein the diameter of the hole corresponds substantially to the diameter of the reinforcement bar.

9. Column shoe according to claim 8, wherein the hole is provided with inner threads and that the reinforcement bar is provided with outer threads which are arranged to cooperate with the inner threads of the hole for securing the reinforcement bar to the upper structure of the bolt housing by screwing.

10. Column shoe according to claim 7, wherein the reinforcement bar is substantially rectilinear and substantially circular in cross-section so that the reinforcement bar is substantially coaxial with the bolt hole in the baseplate of the bolt housing.

11. Column shoe according to claim 1, wherein the attachment unit is secured to the bolt housing by pressing the bolt housing into engagement with the attachment unit.

12. Column shoe according to claim 1, wherein the attachment unit is secured to the hole by means of a sleeve, which is arranged into the hole and on which the attachment unit is secured.

13. Column shoe according to claim 1, wherein attachment lugs, which protrude from the bolt housing, are formed by casting to the bolt housing, for enhancing the fastening of the bolt housing to the steel concrete column.

14. Column shoe according to claim 1, wherein holes are formed in the edge of the baseplate of the bolt housing for securing at least one hole plate to the bolt housing.

15. Column shoe according to claim 1, wherein the bolt housing is formed without welding.

16. Column shoe for securing steel concrete columns to a base, comprising:

a bolt housing comprising a baseplate provided with a bolt hole; and an upper structure which is connected to the baseplate and to which at least one attachment unit is connected for securing the column shoe and the steel concrete column together; wherein:

the bolt housing is a single-piece casting that comprises the upper structure and the baseplate, a hole is formed in the bolt housing for the attachment unit, the hole is substantially coaxial with the bolt hole of the baseplate, the upper structure of the bolt housing comprises a sleeve structure which is formed integrally with the upper structure and on which the hole for the attachment unit is formed, the upper structure of the bolt housing comprises a wall structure by which the sleeve structure is connected with the baseplate, the wall structure in the upper structure of the bolt housing comprises a plurality of wall structure portions by which the sleeve structure is connected with the baseplate, the wall structure portions are arranged symmetrically in relation to the bolt hole and the hole, and the wall structure of the bolt housing tapers in a direction towards the sleeve structure.

* * * * *